US008634582B2

(12) United States Patent
Nielsen

(10) Patent No.: US 8,634,582 B2
(45) Date of Patent: Jan. 21, 2014

(54) HEARING AID WITH AN ELONGATE MEMBER

(75) Inventor: Henrik Nielsen, Roskilde (DK)

(73) Assignee: GN Resound A/S, Ballerup (DK)

( * ) Notice: Subject to any disclaimer, the term of this patent is extended or adjusted under 35 U.S.C. 154(b) by 663 days.

(21) Appl. No.: 12/299,047

(22) PCT Filed: Jun. 22, 2007

(86) PCT No.: PCT/DK2007/000307
§ 371 (c)(1),
(2), (4) Date: Mar. 4, 2009

(87) PCT Pub. No.: WO2007/147417
PCT Pub. Date: Dec. 27, 2007

(65) Prior Publication Data

US 2010/0202643 A1 Aug. 12, 2010

Related U.S. Application Data

(60) Provisional application No. 60/816,246, filed on Jun. 23, 2006.

(30) Foreign Application Priority Data

Jun. 23, 2006 (DK) ..... 2006 00853

(51) Int. Cl.
*H04R 25/00* (2006.01)

(52) U.S. Cl.
USPC ..... 381/323

(58) Field of Classification Search
USPC ..... 381/323
See application file for complete search history.

(56) References Cited

U.S. PATENT DOCUMENTS 3,783,201 A 1/1974 Weiss et al.
4,553,627 A 11/1985 Gastmeier et al.
(Continued)

FOREIGN PATENT DOCUMENTS

CH 673551 A5 2/1984
CN 1124003 A 6/1996
(Continued)

OTHER PUBLICATIONS

Office Action dated Jan. 11, 2012 for CN Application No. 200780030352.X.
(Continued)

*Primary Examiner* — Anthony Ho
(74) *Attorney, Agent, or Firm* — Vista IP Law Group, LLP

(57) ABSTRACT

A hearing aid includes a housing for accommodation of a signal processor for processing an audio signal into a processed audio signal compensating a hearing loss, and a receiver that is connected to an output of the signal processor for converting the processed audio signal into a sound signal, wherein the housing is configured to be positioned in an ear canal of a user without obstructing the ear canal, thereby leaving a passageway between a part of an ear canal wall and a part of the housing so that sound waves can escape from behind the housing through the passageway to surroundings of the user, the housing having an output port for emission of sound towards an eardrum of the user when inserted in the ear canal, and wherein the housing is coupled to an elongate member, which is configured to be placed in a pinna and outside the ear canal of the user for retention of the housing in the ear canal.

25 Claims, 13 Drawing Sheets

(56) References Cited

U.S. PATENT DOCUMENTS

| | | | | |
|---|---|---|---|---|
| 5,048,090 | A | 9/1991 | Geers | |
| 5,201,006 | A | 4/1993 | Weinrich | |
| 5,403,262 | A | 4/1995 | Gooch | |
| 5,619,580 | A | 4/1997 | Hansen | |
| 5,654,530 | A | 8/1997 | Sauer et al. | |
| 5,680,467 | A | 10/1997 | Hansen | |
| 5,784,470 | A | 7/1998 | Fackler et al. | |
| 5,889,874 | A | 3/1999 | Schmitt et al. | |
| 6,493,454 | B1 | 12/2002 | Loi et al. | |
| 6,498,858 | B2 | 12/2002 | Kates | |
| 6,532,294 | B1 | 3/2003 | Rdell | |
| 6,704,423 | B2 | 3/2004 | Anderson et al. | |
| 6,940,989 | B1 * | 9/2005 | Shennib et al. | 381/326 |
| 7,130,437 | B2 | 10/2006 | Stonikas et al. | |
| 7,424,124 | B2 | 9/2008 | Shennib et al. | |
| 7,899,200 | B2 | 3/2011 | Karamuk et al. | |
| 2001/0043707 | A1 | 11/2001 | Leedom | |
| 2001/0051776 | A1 | 12/2001 | Lenhardt | |
| 2004/0047483 | A1 | 3/2004 | Bauman | |
| 2004/0096075 | A1 | 5/2004 | Kuhlmann et al. | |
| 2004/0131200 | A1 | 7/2004 | Davis | |
| 2004/0258264 | A1 | 12/2004 | Jorgensen et al. | |
| 2005/0190940 | A1 | 9/2005 | Ach-Kowalewski et al. | |
| 2006/0050914 | A1 | 3/2006 | Urso et al. | |
| 2006/0147072 | A1 | 7/2006 | Sodoma et al. | |
| 2006/0239483 | A1 | 10/2006 | Orts et al. | |
| 2007/0036374 | A1 | 2/2007 | Bauman | |

FOREIGN PATENT DOCUMENTS

| | | | |
|---|---|---|---|
| DE | 8328154 | U1 | 2/1984 |
| DE | 29801567 | U1 | 4/1998 |
| DE | 19706306 | C1 | 10/1998 |
| DE | 29718483 | U1 | 2/1999 |
| DE | 29718503 | U1 | 4/1999 |
| DE | 29916891 | U1 | 3/2000 |
| EP | 0368125 | A2 | 5/1990 |
| EP | 1448014 | A1 | 8/2004 |
| EP | 1 599 069 | A1 | 11/2005 |
| EP | 1594340 | A | 11/2005 |
| EP | 1653776 | | 5/2006 |
| GB | 2134689 | A | 8/1984 |
| JP | 5-199590 | A | 8/1993 |
| JP | 10-512116 | A | 11/1998 |
| JP | 2003-511940 | A | 3/2003 |
| JP | 2004-229181 | A | 8/2004 |
| WO | WO 9621334 | A1 | 7/1996 |
| WO | WO 9734443 | A1 | 9/1997 |
| WO | 9851125 | A | 11/1998 |
| WO | 00/32009 | | 6/2000 |
| WO | 0076271 | A | 12/2000 |
| WO | 0108443 | A2 | 2/2001 |
| WO | WO 0128289 | A1 | 4/2001 |
| WO | 0203757 | A1 | 1/2002 |
| WO | 02052890 | A1 | 7/2002 |
| WO | 2004010734 | A1 | 1/2004 |
| WO | 2004036953 | | 4/2004 |
| WO | 2007147415 | A1 | 12/2007 |

OTHER PUBLICATIONS

Pawel J. Jastreboff, "Tinnitus Habituation Therapy (THT) and Tinnitus Retraining Therapy (TRT)", In Tyler RS, ed. Handbook of Tinnitus. San Diego: Singular Publishing; 2000:357-375.

Luca Del Bo et al, "Using Open-Ear Hearing Aids in Tinnitus Therapy", Hearing Review, Aug. 2006.

Final Office Action dated Feb. 5, 2013, for JP Patent Application No. 2009-515705.

Non-Final Office Action dated Aug. 18, 2011, for U.S. Appl. No. 12/278,241.

Final Office Action dated Feb. 16, 2012, for U.S. Appl. No. 12/278,241.

Advisory Action dated Apr. 25, 2012, for U.S. Appl. No. 12/278,241.

Non-Final Office Action dated Aug. 16, 2011, for U.S. Appl. No. 12/186,370.

Final Office Action dated Jan. 18, 2012, for U.S. Appl. No. 12/186,370.

Non-Final Office Action dated Oct. 26, 2011, for U.S. Appl. No. 12/299,101.

Final Office Action dated Jun. 21, 2012, for U.S. Appl. No. 12/299,101.

Notice of Allowance and Fee(s) Due dated Jul. 20, 2012, for U.S. Appl. No. 12/278,241.

Notice of Allowance and Fee(s) Due dated Aug. 17, 2012, for U.S. Appl. No. 12/278,241.

Notice of Allowance and Fee(s) Due dated Aug. 21, 2012, for U.S. Appl. No. 12/186,370.

Office Action dated Jul. 10, 2012 for JP Patent Application No. 2009-515705.

English Translation of the Office Action dated Jul. 10, 2012 for JP Patent Application No. 2009-515705.

Office Action dated Jul. 10, 2012 for JP Patent Application No. 2009-515706.

English Translation of the Office Action dated Jul. 10, 2012 for JP Patent Application No. 2009-515706.

Office Action dated Jul. 10, 2012 for JP Patent Application No. 2009-515707.

English Translation of the Office Action dated Jul. 10, 2012 for JP Patent Application No. 2009-515707.

Machine English Translation of JP 05199590 dated Aug. 6, 1993.

Final Office Action dated Sep. 5, 2012, for U.S. Appl. No. 12/299,101.

Corrected Notice of Allowability dated Nov. 6, 2012, for U.S. Appl. No. 12/186,370.

Advisory Action dated Nov. 26, 2012, for U.S. Appl. No. 12/299,101.

Corrected Notice of Allowability dated Oct. 31, 2012, for U.S. Appl. No. 12/278,241.

Written Opinion of the International Search Authority for PCT/DK2007/000305, dated Dec. 23, 2008.

Office Action dated Mar. 15, 2010 for EP Application No. 07722683.5.

International Preliminary Report on Patentability and Written Opinion of the International Search Authority for PCT/DK2007/000307, dated Dec. 23, 2008.

International Preliminary Report on Patentability and Written Opinion of the International Search Authority for PCT/DK2007/000306, dated Dec. 23, 2008.

Non-final Office Action dated Mar. 29, 2013 for U.S. Appl. No. 12/299,101.

Notice of Allowance and Fees Due dated Oct. 4, 2012, for U.S. Appl. No. 12/186,370.

Corrected Notice of Allowability dated Oct. 2, 2012, for U.S. Appl. No. 12/278,241.

Japanese Office Action dated Oct. 1, 2013 for related JP Patent Application No. 2009-515706, 3 pages.

European Office Action dated Nov. 6, 2013 for related EP Patent Application No. 07 722 682.7, 5 pages.

* cited by examiner

A

B

HEARING AID WITH AN ELONGATE MEMBER

RELATED APPLICATION DATA

This application is the national stage of International Application No. PCT/DK2007/000307 filed on Jun. 22, 2007, which claims priority to and the benefit of Denmark Patent Application No. PA 2006 00853, filed on Jun. 23, 2006, and U.S. Provisional Patent Application No. 60/816,246, filed on Jun. 23, 2006, the entire disclosure of all of which is expressly incorporated by reference herein.

This application is related to U.S. patent application Ser. No. 12/278,241.

FIELD

The present application relates to a new type of hearing aid with a housing that is adapted for positioning in the ear canal of a user without obstructing the ear canal and attached to an elongate member that is adapted for positioning in the pinna outside the ear canal of the user.

BACKGROUND

A conventional in the ear (ITE) or completely-in-the-canal (CIC) hearing aid has a housing that is custom made to individually fit the user's ear canal. The hearing aid components, e.g. electronics, microphone, receiver, battery, etc., are contained in the housing which is closed by a faceplate at the end pointing away from the ear canal. In order to reduce occlusion, a so-called vent, i.e. a ventilation channel, is provided for communication between an opening in the faceplate and the user's ear canal. The vent may be drilled through the housing or shell, or a pipe or tube extending within the hearing aid and connecting an opening in the faceplate with an opening at the opposite end of the housing may constitute the vent. The effectiveness of the vent is increased by increasing the cross-section and decreasing the length of the vent channel.

Behind-the-ear (BTE) hearing aids in which a sound tube conducts sound generated by the receiver of the hearing aid into the ear canal are also well known in the art. In order to position the sound tube securely and comfortably in the ear canal, an earpiece is provided for insertion into the ear canal of the user.

Typically, the ITE or CIC housing or the BTE earpiece is individually custom manufactured to fit precisely in the ear canal of the user without causing pain to the user while still retaining the housing or earpiece securely in place in the ear canal preventing the earpiece from falling out of the ear irrespective of movements of the user, such as chewing or yawning, and also avoiding acoustical feedback generating unpleasant and annoying whistling or howling. The custom made earpiece adds to the cost of the hearing aid and the time needed to fit the hearing aid.

Typically, customized hearing aids are made from solid materials to secure retention and tightness. These hearing aids are placed completely or partially in the ear canal. Since the walls of the ear canal are moving when the jaws move for instance when chewing, the placement of such solid hearing aids in the ear canal can be associated with discomfort for the user.

Several approaches to eliminate this discomfort have been tried, one such approach is to make the canal portion of the device in a soft material, e.g. as disclosed in WO 02/03757 A1. Such devices are complicated to manufacture and will only offer limited venting.

In WO 2004/010734, a canal hearing device is disclosed having a dual acoustic seal system for preventing feedback while minimizing occlusion effects. The two-part device comprises a main module and an elongated tubular insert for conducting sound to the eardrum and sealing within the bony region of the ear canal. The main module is positioned in the cartilaginous portion of the ear canal. The tubular insert comprises a sound conduction tube and a cylindrically hollow primary seal medially positioned in the bony region. The device also comprises a secondary seal laterally positioned in the cartilaginous region.

WO 01/08443 discloses a one-size-fits-all hearing aid, which is adapted to fit into either ear of an ear canal of a user to a depth proximal to the tympanic membrane. The hearing aid is comprised of two half shells joined together to house the hearing aid components. The joined shells secure a flexible tip at the distal end of the shell.

SUMMARY

It is an object to provide a hearing aid wherein a part of the hearing aid can be securely and comfortably positioned and retained inside the ear canal of a user similar to the housing of a CIC hearing aid.

It is another object to provide the hearing aid in standard sizes eliminating the need for customization.

According to some embodiments, the above and other objects are fulfilled by a hearing aid with a housing for accommodation of electronic components and adapted to be positioned in the ear canal of a user without obstructing the ear canal and having an output port for emission of sound towards the eardrum of the user when inserted in the ear canal. The housing is attached to an elongate member adapted for positioning in the pinna and outside the ear canal of the user.

The elongate member has a first end attached to the housing and an opposite second end.

In accordance with hearing aid terminology, the housing is denoted an open housing, i.e. the housing does not obstruct the ear canal when it is positioned in its intended operational position in the ear canal. There will be a passageway between a part of the ear canal wall and a part of the housing so that sound waves may escape from behind the housing between the ear drum and the housing through the passageway to the surroundings of the user. In this way, the occlusion effect is diminished and preferably substantially eliminated.

The first thing that people being fitted with a hearing aid note is usually the change of their voice. They typically describe the sound of their own voice in one of the following terms: "My voice echoes", "My voice sounds hollow" or "I sound like I'm talking in a barrel". Their altered perception of their own voice is mainly due to occlusion of the ear canal by the housing or earpiece.

Sounds originating from the vocal tract (throat and mouth) are transmitted into the ear canal through the cartilaginous tissue between these cavities and the outer portion of the ear canal.

When nothing is positioned in the ear canal, most of this predominantly low frequency sound simply escapes from the ear canal. However, when the ear canal is blocked these bone-conducted sounds cannot escape from the ear canal. The result is a build-up of high sound pressure levels in the residual ear canal volume. This increase in low frequency sound pressure is audible and will cause them to hear their own voice as loud and boomy. Change in perception of own voice is the most dominant occlusion related complaint, but not the only one. Other occlusion related problems include too much amplification at low frequencies for hearing aid users with good low frequency hearing, reduced speech intelligibility, poorer localization, physical discomfort and increased risk of external ear irritation and infection. Hearing aid users do not adapt to occlusion and the occlusion effect has been cited by as many as 27% of hearing aid wearers as a reason for dissatisfaction with their hearing aids. This emphasizes the need for alleviating or, even better, eliminating the occlusion effect.

A hearing aid comprises a microphone for converting sound into an audio signal, a signal processor for processing the audio signal into an audio signal compensating a hearing loss, and a loudspeaker that is connected to an output of the signal processor for converting the processed compensated audio signal into a sound signal. Further, the hearing aid comprises a battery for power supply of the electric components of the hearing aid.

In accordance with hearing aid terminology, the loudspeaker is also denoted a receiver throughout the present specification.

In one embodiment, the housing accommodates the abovementioned hearing aid components including the microphone in a way similar to the housing of a CIC hearing aid. In another embodiment, the elongate member accommodates the microphone at its second end and the housing accommodates the other components, and signal conductors extend within the elongate member for electrical interconnection of the microphone with other components in the hearing aid housing.

In one embodiment, the housing and the elongate member form an integral member that is manufactured in one piece.

In another embodiment, the elongate member and the housing form separate units that are manufactured in separate pieces.

In yet another embodiment, the housing and the elongate member are manufactured as separate parts that are interconnected mechanically and possibly electrically during manufacture of the hearing aid.

The housing is preferably manufactured in a number of standard sizes to fit the human anatomy of the ear canal of most users. In this way, the manufacturing cost is lowered as compared to the manufacturing cost of customized housings.

The elongate member is preferably manufactured in a number of standard sizes to fit the human anatomy of the pinna of most users. In this way, the manufacturing cost is lowered as compared to the manufacturing cost of customized elongate members.

In a preferred embodiment, the elongate member is removably interconnected with the housing so that a large number of different models of the hearing aid may be provided by combining elongate members of different standard sizes with housings of different standard sizes.

The housing may comprise a battery door providing access to a battery compartment. The elongate member may be attached to the battery door and the battery door may be removably attached to the housing with a connector for removal of the elongate member from the housing together with the battery door.

The connector may further be adapted for making electrical contact with a signal line in the elongate member when the battery door is attached to the housing.

In one embodiment, the elongate member is adapted to be positioned in the pinna of the user around the circumference of the conchae abutting the antihelix and at least partly covered by the antihelix for retainment of its position.

The elongate member may be preformed during manufacture, preferably into an arched shape with a curvature slightly larger than the curvature of the antihelix, for easy fitting of the elongate member into its intended position in the pinna.

The elongate member may be resilient for assisting in retaining the housing in the ear canal of the user so that the housing remains securely in place in the ear canal without falling out of the ear irrespective of movements of the user, such as chewing or yawning. Retention is provided without causing pain to the user.

The elongate member may further be adapted to abut part of the concha at the antitragus when the housing has been inserted in the ear canal thereby applying a force to the housing towards the ear canal retaining the housing in a position in which the housing is pressed against an anatomical feature within the ear canal.

Retention of the hearing aid in the proper place is important. Jaw movements can exert outward forces on the canal portion of the hearing aid. In an embodiment, the elongate member has sufficient resilience to counteract this force and sufficiently securing the hearing aid from outward motion.

Preferably, the elongate member is resilient in a direction perpendicular to its longitudinal extension thereby providing further capability of retention of the housing in the ear canal of the user. During positioning of the housing in its intended position in the ear canal of the user, the transverse resilience of the elongate member facilitates insertion of the housing into the ear canal of the user.

Preferably, the elongate member is adapted to abut the antihelix and extend at least to the inferior crus of the antihelix when the housing is positioned in the ear canal of the user.

More preferred the elongate member is adapted for positioning of the second end at the cimba concha below the triangular fossa of the ear of the user when the housing is positioned in the ear canal of the user.

The elongate member may be adapted for accommodation of a microphone at the second end. The elongate member may have a larger cross-section at the second end accommodating the microphone than a remaining part of the elongate member extending therefrom and towards the first end.

Positioning of the microphone of the hearing aid at the second end of the elongate member provides a large distance between the microphone and the receiver thereby minimizing feedback.

Feedback limits the maximum gain available to the user of the hearing aid. Feedback refers to the amplified sound returning to the hearing aid microphone from the hearing aid output port mainly through the passageway between the housing and the ear canal wall. Oscillation arises when the attenuation provided by the feedback path is smaller than the hearing aid gain. A large distance between the microphone and the receiver alleviates this problem.

As further described below, electronic feedback suppression may also be provided in the hearing aid.

The elongate member may accommodate further electrical hearing aid components.

In an embodiment with a microphone at the second end of the elongate member, the elongate member is preferably substantially rigid in the direction of its longitudinal extension so that electrical conductors residing in the elongate member are protected against breaking.

With a microphone in the elongate member at its second end, localisation is substantially maintained when the microphone is positioned at a location within the pinna wherein the microphone receives a sound signal that allows the user to perceive the direction towards a sound source. Then, the sound signal based on which the user is capable of perceiving direction is transmitted to the ear drum of the user by the hearing aid. For example, sense of direction may be substantially maintained when the microphone is positioned at the cimba concha below the triangular fossa in the pinna.

Two microphones may be accommodated at the second end of the elongate member for provision of noise suppression and/or further directionality.

In a preferred embodiment, the housing forms an angle along its longitudinal extension facilitating accommodation of the housing in the ear canal of the user.

Preferably, the housing is flexible for variation of the angle for accommodation of the housing to different angles of different users.

Preferably, the housing is flexible for comfortable accommodation of the housing in the ear canal of the user providing a high level of comfort.

The hearing aid may further comprise a cerumen filter that is adapted to be fitted on a loudspeaker with a snap on coupling.

The housing may have a cross-section that is smaller than the cross-section of the ear canal so that occlusion substantially does not occur. When the housing is inserted into the user's ear canal, the smaller cross-section of the housing allows communication between the ear canal between the eardrum and the housing and the surroundings for prevention of occlusion.

In a preferred embodiment, electronic feedback compensation is provided. Feedback is a well-known problem in hearing aids and several systems for suppression and cancellation of feedback exist within the art. With the development of very small digital signal processing (DSP) units, it has become possible to perform advanced algorithms for feedback suppression in a tiny device, such as a hearing aid, see e.g. U.S. Pat. No. 5,619,580, U.S. Pat. No. 5,680,467 and U.S. Pat. No. 6,498,858.

The above mentioned prior art systems for feedback cancellation in hearing aids deal with external feedback, i.e. transmission of sound between the loudspeaker (often denoted receiver) and the microphone of the hearing aid along a path outside the hearing aid device. This problem, which is also known as acoustical feedback, occurs e.g. when a hearing aid earpiece part does not completely fit the user's ear, or in the case of an earpiece part comprising a vent. In both examples, sound may "leak" from the receiver to the microphone and thereby cause feedback.

The problem of external feedback limits the maximum gain available in a hearing aid.

Thus, the hearing aid may further comprise a feedback compensation circuit for providing a feedback compensation signal of signals picked up by the microphone by modelling an acoustical and mechanical feedback signal path of the hearing aid, subtracting means for subtracting the feedback compensation signals from the audio signal to form a compensated audio signal, which is input to the signal processor of the hearing aid.

The feedback signal path is typically an acoustic path between the microphone and the receiver, i.e. an external feedback signal propagates through air surrounding the hearing aid.

Preferably, the feedback compensation means comprises an adaptive filter, i.e. a filter that changes its impulse response in accordance with changes in the feedback path.

Both static and adaptive filters are well known to a person skilled in the art of hearing aids, and will therefore not be discussed in further detail here.

Tinnitus is the perception of sound in the human ear in the absence of corresponding external sound(s). Tinnitus is considered a phantom sound, which arises in the auditory system. For example, a ringing, buzzing, whistling, or roaring sound may be perceived as tinnitus. Tinnitus can be continuous or intermittent, and in either case can be very disturbing, and can significantly decrease the quality of life for one who has such an affliction.

Tinnitus is not itself a disease but an unwelcome symptom resulting from a range of underlying causes, including psychological factors such as stress, disease (infections, Menieres Disease, Oto-Sclerosis, etc.), foreign objects or wax in the ear and injury from loud noises. Tinnitus is also a side-effect of some medications, and may also result from an abnormal level of anxiety and depression.

The perceived tinnitus sound may range from a quiet background sound to a signal loud enough to drown out all outside sounds. The term 'tinnitus' usually refers to more severe cases. A 1953 study of 80 tinnitus-free university students placed in a soundproofed room found that 93% reported hearing a buzzing, pulsing or whistling sound. However, it must not be assumed that this condition is normal—cohort studies have demonstrated that damage to hearing from unnatural levels of noise exposure is very widespread.

Tinnitus cannot be surgically corrected and since, to date, there are no approved effective drug treatments, so-called tinnitus maskers have become known. These are small, battery-driven devices which are worn like a hearing aid behind or in the ear and which, by means of artificial sounds which are emitted, for example via a hearing aid speaker into the auditory canal, to thereby psycho acoustically mask the tinnitus and thus reduce the tinnitus perception.

The artificial sounds produced by the maskers are often narrow-band noise. The spectral position and the loudness level of the noise can often be adjusted via for example a programming device to enable adaptation to the individual tinnitus situation as optimally as possible. In addition, so-called retraining methods have been developed, for example tinnitus retraining therapy (Jastreboff P J. Tinnitus habituation therapy (THI) and tinnitus retraining therapy (TRT). In: Tyler R S, ed. Handbook of Tinnitus. San Diego: Singular Publishing; 2000:357-376) in which, by combination of a mental training program and presentation of broad-band sound (noise) near the auditory threshold, the perceptibility of the tinnitus in quiet conditions is likewise supposed to be largely suppressed. These devices are also called "noisers" or "sound enrichment devices". Such devices or methods are for example known from DE 29718 503, GB 2 134 689, US 2001/0051776, US 2004/0131200 and U.S. Pat. No. 5,403,262.

Although present day tinnitus maskers to a certain extent may provide immediate relief of tinnitus, the masking sound produced by them may adversely affect the understanding of speech, partly because S/N (Speech/Noise) ratio would be lower due to the addition of noise, and partly because persons suffering from tinnitus often also suffer from a reduced ability to understand speech in noise as compared to people with normal hearing.

For many people, the known maskers will not provide any long term relief of tinnitus. Recent research conducted by Del Bo, Ambrosetti, Bettinelli, Domenichetti, Fagnani, and Scotti "Using Open-Ear Hearing Aids in Tinnitus Therapy", Hearing Review, August 2006, has indicated that better long term effects for tinnitus relief may be achieved if so-called habituation of tinnitus is induced in a tinnitus sufferer by using sound enrichment by sound from the ambient environment. The rationale behind habituation relies on two fundamental aspects of brain functioning: Habituation of the reaction of the limbic and sympathetic system, and habituation of sound perception allowing a person to ignore the presence of tinnitus. While tinnitus maskers emit sounds that either partly or completely cover the perceived sound of tinnitus, Del Bo, Ambrosetti, Bettinelli, Domenichetti, Fagnani, and Scotti suggest the use of environmental sounds amplified by a hearing aid or by application of artificial sounds, such as band limited noise. According to an aspect, the hearing aid also includes a tinnitus relieving circuit, for example generating sounds useful for relieving tinnitus as described above. The relieving circuit may for example be a tinnitus masker, a sound enrichment circuit, etc.

According to another aspect, a tinnitus relieving device is provided with a housing and an elongate member as disclosed throughout the present disclosure. The tinnitus relieving device does not have a microphone. In one embodiment, the tinnitus relieving device does not compensate for a hearing loss.

In accordance with some embodiments, a hearing aid includes a housing for accommodation of a signal processor for processing an audio signal into a processed audio signal compensating a hearing loss, and a receiver that is connected to an output of the signal processor for converting the processed audio signal into a sound signal, wherein the housing is configured to be positioned in an ear canal of a user without obstructing the ear canal, thereby leaving a passageway between a part of an ear canal wall and a part of the housing so that sound waves can escape from behind the housing through the passageway to surroundings of the user, the housing having an output port for emission of sound towards an eardrum of the user when inserted in the ear canal, and wherein the housing is coupled to an elongate member, which is configured to be placed in a pinna and outside the ear canal of the user for retention of the housing in the ear canal.

DESCRIPTION OF DRAWING FIGURES

The above and other features and advantages will become more apparent to those of ordinary skill in the art by describing in detail exemplary embodiments thereof with reference to the attached drawings in which.

Figure 4:
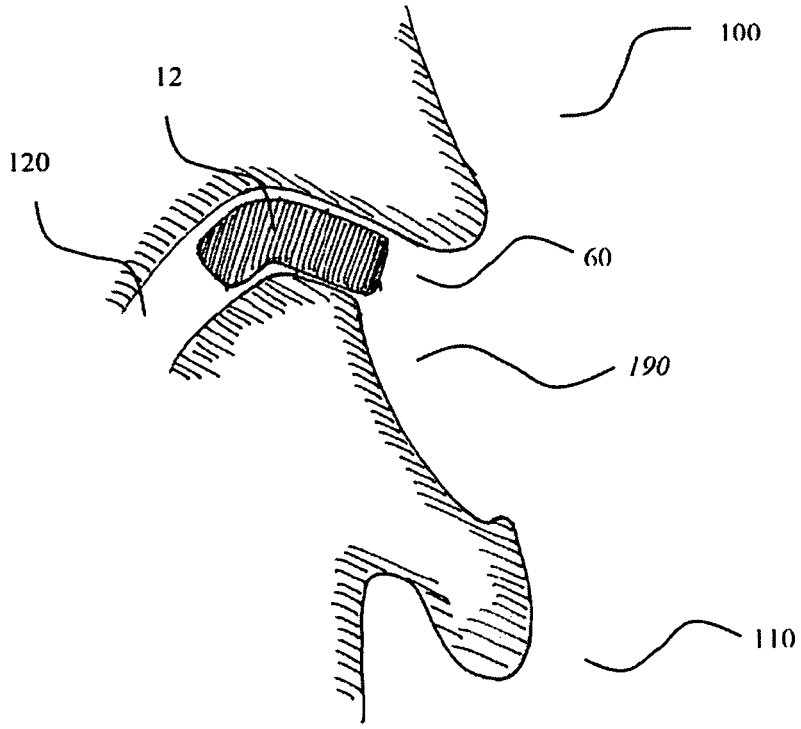
Figure 5:
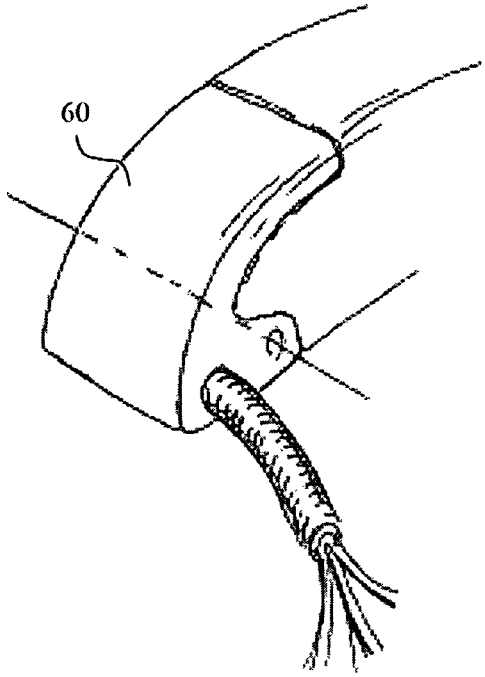
Figure 6:
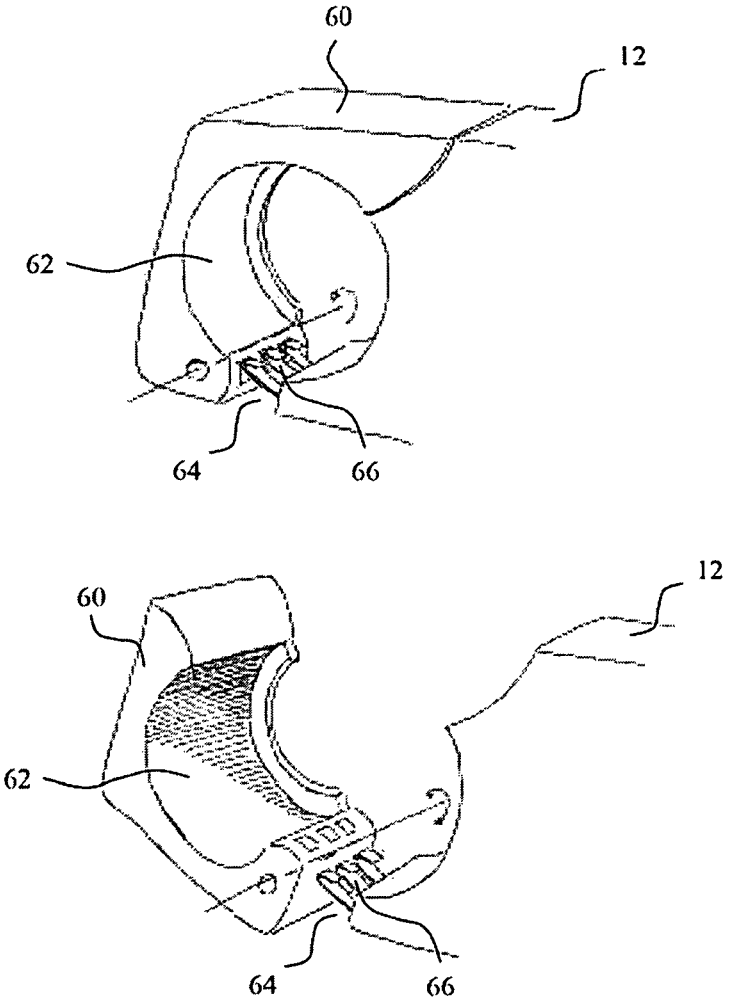
Figure 7:
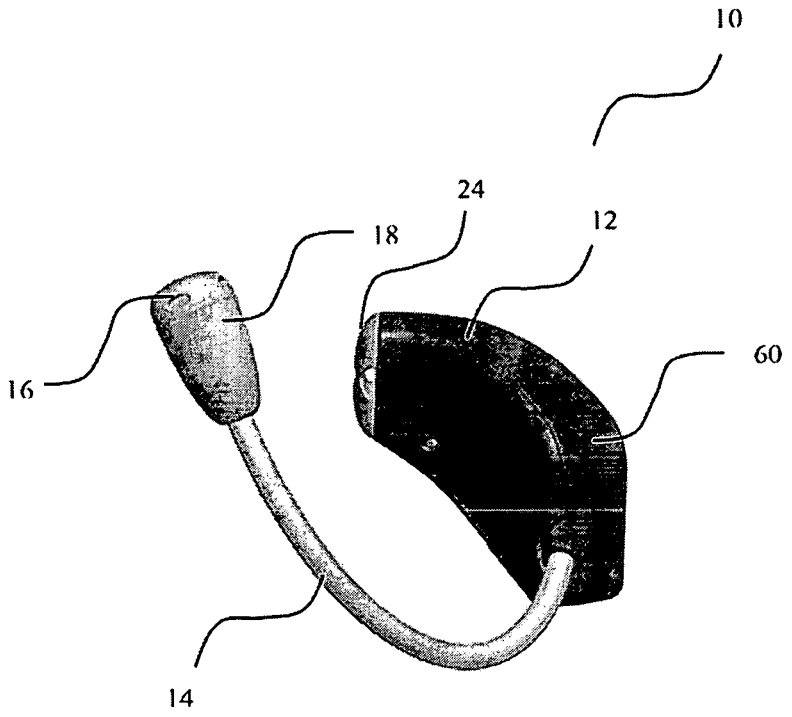
Figure 8:
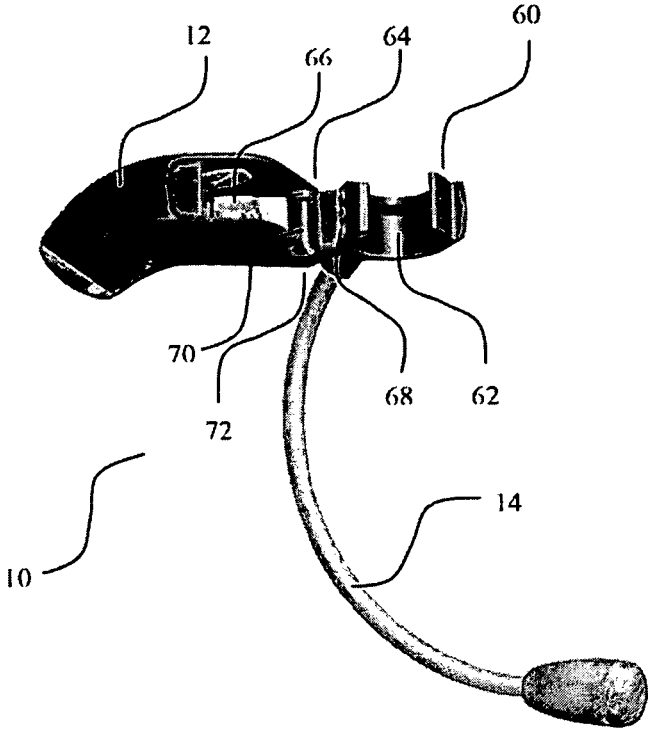
Figure 9:
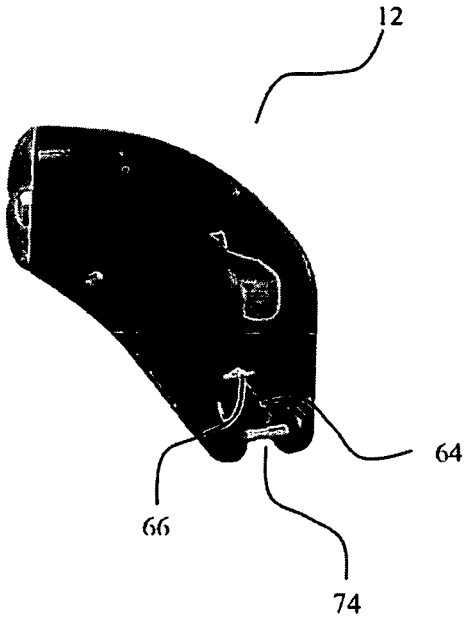
Figure 10:
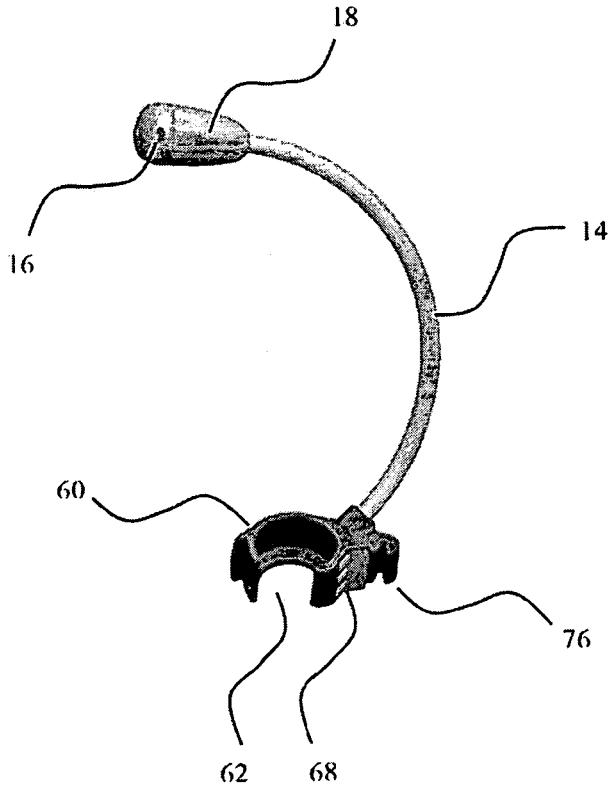
Figure 11:
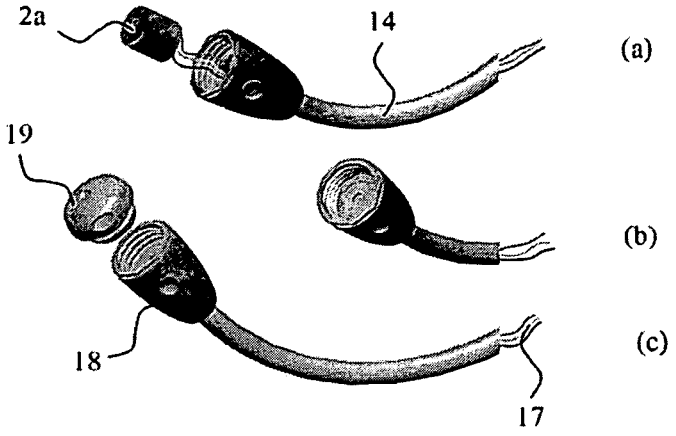
Figure 12:
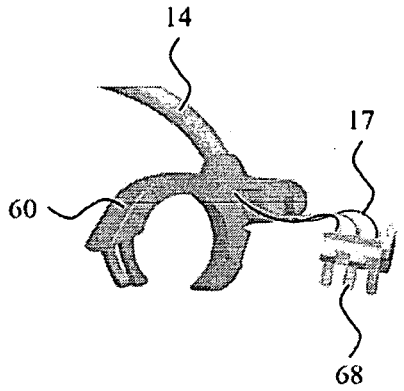
Figure 13:
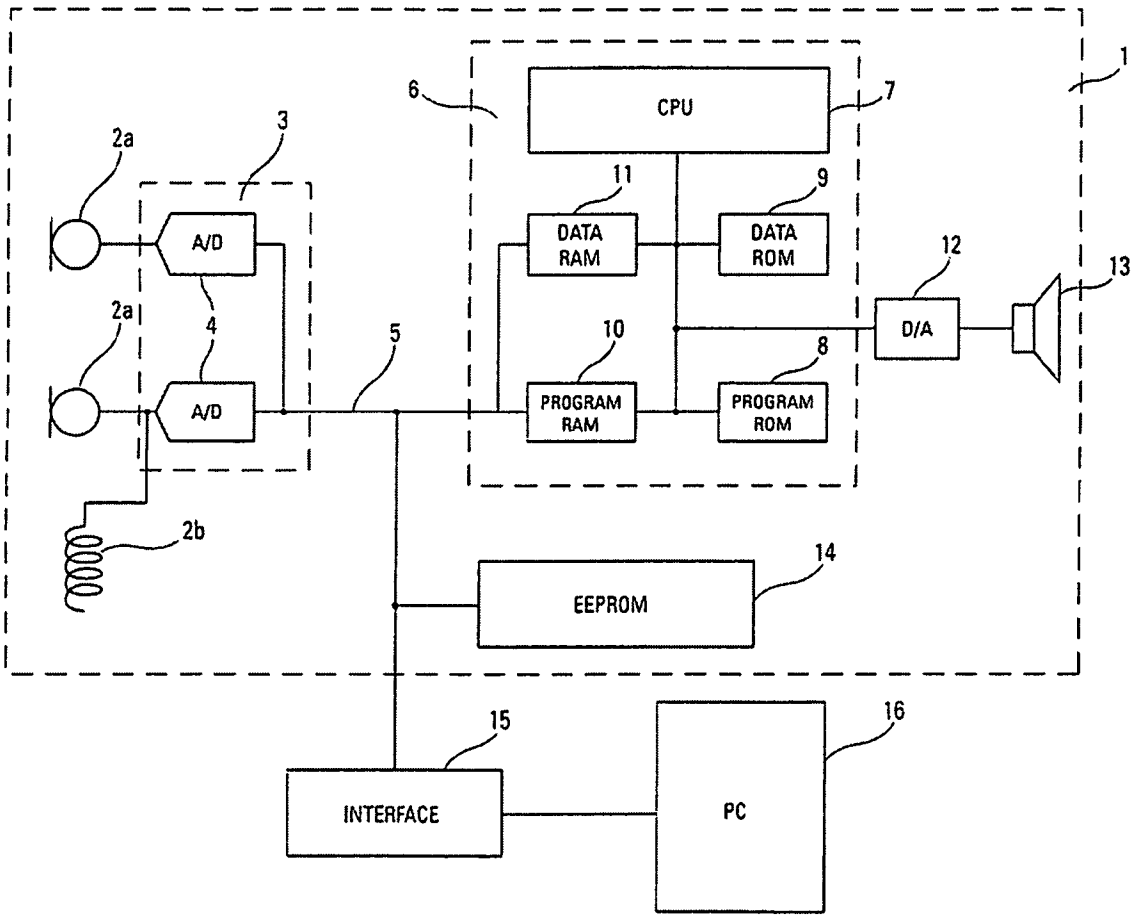
Figure 14:
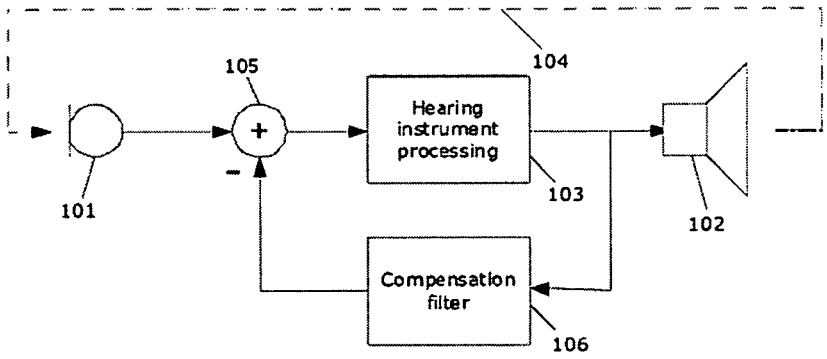

FIG. 4 illustrates the position of the hearing aid housing in the ear canal during use, FIG. 5 shows an embodiment with a battery door, FIG. 6 shows an embodiment with a battery door and a connector, FIG. 7 shows in perspective an embodiment of a hearing aid, FIG. 8 shows from above the embodiment of FIG. 7 with an open battery door, FIG. 9 shows the hearing aid housing of the embodiment of FIGS. 7 and 8, FIG. 10 shows the elongate member connected to a battery door of the embodiment of FIGS. 7 and 8, FIG. 11 illustrates positioning of a microphone at the second end of an elongate member, FIG. 12 shows a detail of an interconnection between an elongate member and a battery door, FIG. 13 shows a simplified block diagram of a digital healing aid enclosed in a housing, and FIG. 14 shows a block diagram of a hearing aid with one feedback compensation filter.

DETAILED DESCRIPTION

The embodiments will now be described more fully hereinafter with reference to the accompanying drawings. Like reference numerals refer to like elements throughout except in FIG. 5 wherein reference numerals 1-16 designate electronic circuits. The embodiments may, however, be embodied in different forms and should not be construed as limited to the embodiments set forth herein. Rather, these embodiments are provided so that this disclosure will be thorough and complete, and will fully convey the scope of the application to those skilled in the art. Like reference numerals refer to like elements throughout. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

Figure 1:
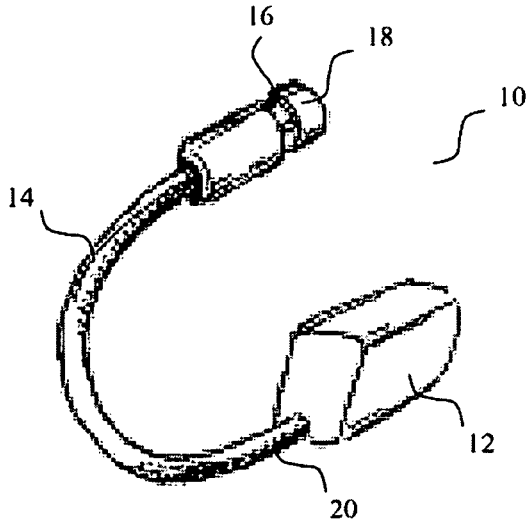
FIG. 1 is a perspective view of a first embodiment.
Figure 2:
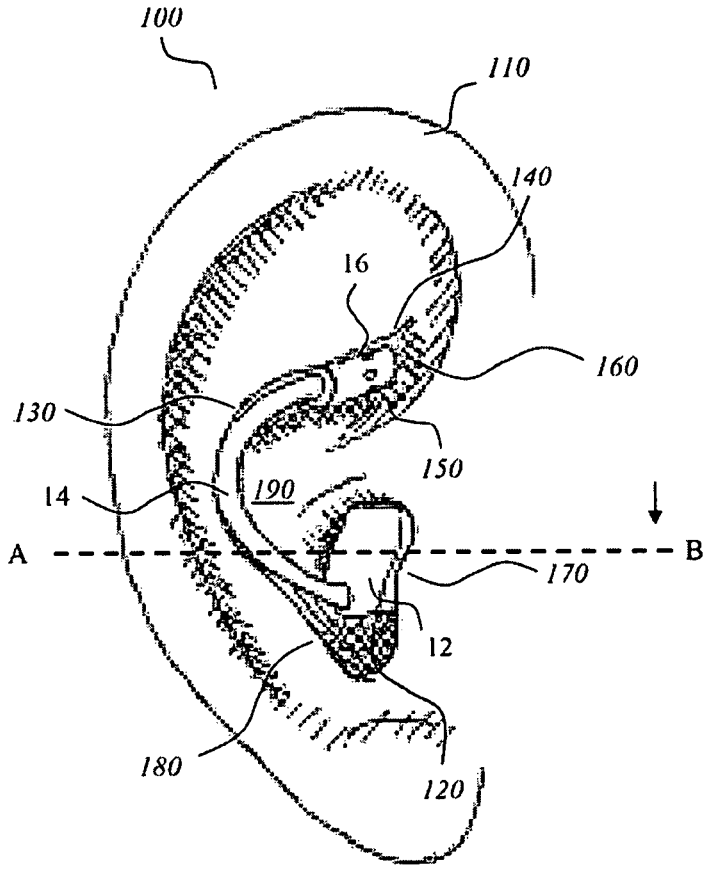
FIG. 2 shows the first embodiment positioned in the ear of a user.

FIG. 1 shows in perspective a first embodiment of a hearing aid 10. FIG. 2 shows the embodiment of FIG. 1 positioned in the ear of a user. The illustrated hearing aid 10 has a housing 12 for accommodation of hearing aid components and adapted to be positioned in the ear canal 120 of a user comfortably fitting the ear canal 120 for retention of the housing 12 in the ear of the user. The housing 12 has loudspeaker (not shown) for emission of sound through an output port (not shown) towards the eardrum of the user.

The housing 12 further comprises an elongate member 14 that is attached to the housing 12 and adapted for positioning within the pinna 100 during use. More specifically, the elongate member 14 is adapted to be positioned in the cimba concha 160 of the ear of the user. In the illustrated embodiment, the elongate member 14 and the housing 12 form separate units that are manufactured in separate pieces. The microphone of the hearing aid 10 is positioned at the microphone input port 16 at the second end 18 of the elongate member 14. The housing 12 accommodates the other components. Signal conductors extend within the elongate member 14 for electrical interconnection of the microphone with the other components in the housing 12.

Positioning of the microphone(s) of the hearing aid at the second end of the elongate member 14 provides an increased distance between the microphone(s) and the output port as compared to the corresponding distance in conventional ITE and CIC hearing aid aids whereby acoustic feedback is diminished.

In the illustrated embodiment, the housing 12 and elongate member 14 are manufactured as separate parts that are removably interconnected mechanically and electrically.

The illustrated housing 12 and the elongate member 14 are manufactured in a number of respective standard sizes to fit the human anatomy of the ear of most users. In this way, the manufacturing cost is lowered as compared to the manufacturing cost of customized housings.

As illustrated in more detail in FIGS. 5 and 6, the elongate member 14 is removably interconnected with the housing 12 so that a large number of different models of the hearing aid 10 may be provided by combining elongate members 14 of different standard sizes with housings 12 of different standard sizes.

The elongate member 14 is adapted to be positioned in the concha of the pinna 100 of the user and has a longitudinal shape with a first end 20 attached to the housing 12 and an opposite second end 18.

The elongate member 14 assists in retaining the housing 12 in the ear canal 120 of the user so that the housing 12 remains securely in place in the ear canal 120 without falling out of the ear. Retention is provided without causing pain to the user. Retention of the device in the proper place is important. Jaw movements during chewing for instance can exert outward forces on the housing 12 of the hearing aid. The elongate member 14 counteracts this force thereby sufficiently securing the housing 12 from outward motion.

The illustrated elongate member 14 is resilient in a direction perpendicular to the longitudinal extension thereby providing further retention capability of the housing 12 in the ear canal 120 of the user. During positioning of the housing 12 in its intended position in the ear canal 120 of the user, the transverse resilience of the elongate member 14 facilitates insertion of the housing 12 into the ear canal 120 of the user.

The elongate member 14 is adapted to abut the antihelix 130 and extend to the inferior crus 150 of the antihelix so that the second end 18 is positioned at the cimba concha 160 of the ear below the triangular fossa when the hearing aid 10 is positioned in the ear of the user.

The elongate member 14 has a larger cross-section at the second end 18 accommodating the microphone than a remaining part of the elongate member 14 extending therefrom and towards the first end 20.

The elongate member 14 may accommodate further electrical hearing aid components.

The illustrated elongate member 14 is substantially rigid in the direction of its longitudinal extension so that electrical conductors residing in the elongate member 14 are protected against breaking.

With a microphone in the elongate member 14 at its second end 18 that is positioned at the cimba concha 160 of the ear below the triangular fossa, localisation is substantially maintained since the microphone is positioned at a location within the pinna 100 wherein the received sound signal enables the user to perceive direction towards a sound source from the signal transmitted to the ear drum of the user by the hearing aid 10.

Figure 3:
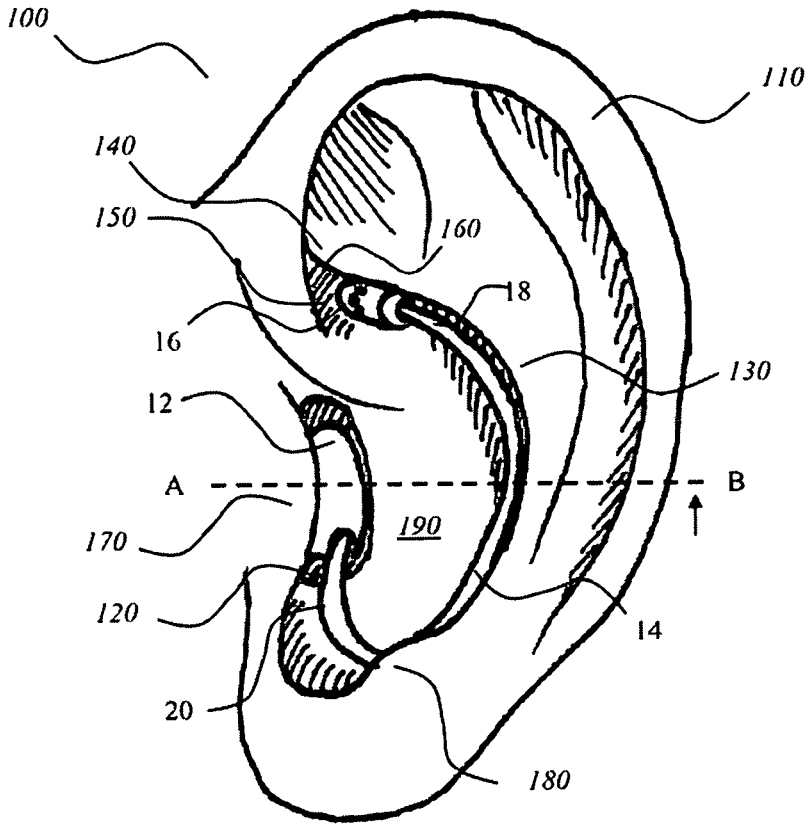
FIG. 3 shows a second embodiment positioned in an ear of a user.

Two microphones may be accommodated at the second end 18 of the elongate member 14 for provision of noise suppression and/or further directionality. FIG. 3 shows another embodiment of a hearing aid (also shown in FIG. 7) positioned in an ear of a user. The illustrated hearing aid may have all of the features of the hearing aid shown in FIGS. 1 and 2.

In addition to the features of the elongate member 14 shown in FIGS. 1 and 2, the elongate member shown in FIGS. 3 and 7 is further adapted to abut part of the concha at the antitragus 180 when the housing 12 has been inserted in the ear canal 120 thereby applying a force to the housing towards the ear canal retaining the housing in a position in which the housing is pressed against an anatomical feature within the ear canal.

FIG. 4 shows the positioning of a the hearing aid housing in the ear canal 120 of a user. The cross-section of FIG. 4 is taken along line AB in FIG. 2 or 3. The viewing direction is indicated by the arrow. The housing 12 forms an angle along its longitudinal extension facilitating accommodation of the housing in the ear canal 120 of the user.

Preferably, the housing is flexible for variation of the angle for accommodation of the housing to different angles of different users. Preferably, the housing is flexible for comfortable accommodation of the housing in the ear canal of the user providing a high level of comfort.

The illustrated housing 12 has a cross-section that is smaller than the cross-section of the ear canal 120 so that occlusion substantially does not occur. When the housing 12 is inserted into the users ear canal 120, the smaller cross-section of the housing allows communication between the ear canal between the eardrum and the housing and the surroundings for prevention of occlusion. The illustrated hearing aid housing 12 is positioned completely in the ear canal of the user like a conventional CIC hearing aid. When the hearing aid housing is properly inserted into the ear canal of the user, the outward pointing end of the hearing aid housing with the battery door 60 is aligned with, or approximately aligned with, the cavum conchae 190, i.e. the battery door 60 coincides with, or approximately coincides with, the delimitation between the cavum conchae and the ear canal.

FIGS. 5 and 6 illustrate an embodiment of a battery door 60 of the housing 12 in more detail. The battery door 60 is provided at the proximate end of the housing 12 facing out of the ear canal when the hearing aid 10 is positioned in the ear. The battery door 60 has a compartment 62 accommodating the battery (not shown). The battery compartment 62 swings out of the housing 12 when the battery door 60 is opened whereby the battery may be exchanged with a new battery. The elongate member 14 is attached to the battery door 60 and the battery door 60 is removably attached to the housing 12 with a connector 64 comprising resilient electrical contact members 66 for electrical interconnection of signal conductors in the elongate member 14 with electrical components in the housing 12.

FIG. 7 shows in perspective an embodiment of a hearing aid 10. As already mentioned with reference to FIG. 3, the features of the hearing aid illustrated in FIG. 7 may have all of the features of the hearing aid shown in FIGS. 1 and 2. The embodiment of FIGS. 3 and 7 comprises a cerumen filter 24 that is fitted on the part of the housing 12, which part accommodates the loudspeaker. The cerumen filter 24 is coupled to the housing 12 by means of a snap fit coupling.

FIG. 8 shows from above the embodiment of FIG. 7 with an open battery door 60. The battery door 60 is provided at the proximate end of the housing 12 pointing out of the ear canal when the hearing aid 10 is positioned in the ear. The battery door 60 has a compartment 62 accommodating the hearing aid battery (not shown). The user may open or close the battery door 60 by rotating the battery door around an axis of rotation provided by a hinge connection 72. The battery compartment 62 swings out of the housing 12 when the battery door 60 is opened whereby the battery may be exchanged with a new battery.

The elongate member 14 is attached to the battery door 60 and the battery door 60 is removably attached to the housing 12 with a connector 64 including the hinge connection 72. In the illustrated embodiment, the hinge connection 72 has a shaft 74, and the battery door 60 has a flexible recess 76 so that a person may attach the battery door 60 to the hearing aid housing 12 by pressing the recess 76 around the shaft 74 whereby the recess 76 expands slightly to accommodate the shaft 74 and snaps back for retention of the shaft within the recess. Likewise, the user may remove the battery door 60 from the hearing aid housing 12 by pulling the battery door 60 away from the hearing aid housing 12 whereby the recess expands to release the shaft and snaps back into its original relaxed shape upon release of the shaft 74. The illustrated snap fit coupling for interconnection of the battery door 60 with the hearing aid housing 12 is designed so that the force required to separate the battery door 60 from the hearing aid housing 12 is larger than the force required to pull the hearing aid housing 12 out of the ear canal of the user by pulling the elongate member 14.

The illustrated hearing aid housing connector 64 further comprises resilient electrical contact members 66 for electrical interconnection of signal conductors in the elongate member 14 with electrical components in the housing 12.

FIG. 9 shows the hearing aid housing 12 with the battery door 60 removed, and FIG. 10 shows the removed battery door 60 with the elongate member 14.

It is an important advantage of the illustrated embodiment that electrical contact members 68 of the interconnected battery door 60 and elongate member 14 mating the contact members 66 of the hearing aid housing connector 64 connect slidably with respective electrical contact members 66 of the housing 12 when the battery compartment 62 is closed by rotation. The sliding connection provides a cleaning action thereby cleaning the contact surfaces maintaining a low contact resistance across the electrical interconnection of the hearing aid components, e.g. by mechanical removal of oxide film formed on the contact surfaces, or mechanical removal of other undesired deposits on the contact surfaces.

In another embodiment, the elongate member 14 is removably connected directly with the hearing aid housing 12. In this embodiment (not shown), the elongate member 14 has an electrical connector at its second end mating a corresponding hearing aid housing connector. The elongate member 14 with the connector is inserted through a hole provided in the hearing aid housing. The battery door 60 may be provided with a suitable mechanical member that assists in attaching the elongate member 14 to the hearing aid housing 12 by abutment with the elongate member 14 when the battery door 60 is closed. The battery door may include locking means preventing the battery door from being inadvertently opened e.g. due to forces applied to the elongate member 14.

FIGS. 11 (*a*)-(*c*) illustrate positioning of a microphone 2*a* at the second end 18 of an elongate member 14 in accordance with an embodiment. As shown in FIG. 11 (*a*), the microphone 2*a* and its signal conductors 17 are inserted into the elongate member 14 through an open second end 18.*of* the elongate member 14, and the microphone 2*a* is pushed into its desired position shown in FIG. 11 (*b*). The signal conductors 17 with the signal line of the microphone 2*a* extend inside the elongate member 14. Finally, a threaded cap 19 with the cerumen filter closes the opening of the elongate member 14 as illustrated in FIG. 11 (*c*).

FIG. 12 illustrates the interconnection of the signal conductors 17 with the contact members 68 in accordance with an embodiment. In the illustrated embodiment, the contact members 68 are provided on a slide member that may slide into a mating compartment in the battery door for positioning of the contact members 68 as for example illustrated in FIG. 10. Upon insertion of the microphone 2*a* and the signal conductors 17 into the elongate member 14, the exposed ends of the signal conductors 17 or soldered onto the contact members 68 provided on the slide member. Subsequently, the slide member is inserted into the battery door 60 and possibly glued to the battery door.

FIG. 13 shows a simplified block diagram of a digital hearing aid. The hearing aid 1 comprises one or more sound receivers 2, e.g. two microphones 2*a* and a telecoil 2*b*. The analogue signals for the microphones are coupled to an analogue-digital converter circuit 3, which contains an analogue-digital converter 4 for each of the microphones.

The digital signal outputs from the analogue-digital converters 4 are coupled to a common data line 5, which leads the signals to a digital signal processor (DSP) 6. The DSP is programmed to perform the necessary signal processing operations of digital signals to compensate hearing loss in accordance with the needs of the user. The OSP is further programmed for automatic adjustment of signal processing parameters in accordance with some embodiments.

The output signal is then fed to a digital-analogue converter 12, from which analogue output signals are fed to a sound transducer 13, such as a miniature loudspeaker.

In addition, externally in relation to the DSP 6, the hearing aid contains a storage unit 14, which in the example shown is an EEPROM (electronically erasable programmable read-only memory). This external memory 14, which is connected to a common serial data bus 5, can be, provided via an interface 15 with programmes, data, parameters etc. entered from a PC 16, for example, when a new hearing aid is allotted to a specific user, where the hearing aid is adjusted for precisely this user, or when a user has his hearing aid updated and/or re-adjusted to the user's actual hearing loss, e.g. by an audiologist.

The DSP 6 contains a central processor (CPU) 7 and a number of internal storage units 8-11, these storage units containing data and programmes, which are presently being executed in the DSP circuit 6. The DSP 6 contains a programme-ROM (read-only memory) 8, a data-ROM 9, a programme-RAM (random access memory) 10 and a data-RAM 11. The two first-mentioned contain programmes and data which constitute permanent elements in the circuit, while the two last-mentioned contain programmes and data which can be changed or overwritten.

Typically, the external EEPROM 14 is considerably larger, e.g. 4-8 times larger, than the internal RAM, which means that certain data and programmes can be stored in the EEPROM so that they can be read into the internal RAMS for execution as required. Later, these special data and programmes may be overwritten by the normal operational data and working programmes. The external EEPROM can thus contain a series of programmes, which are used only in special cases, such as e.g. start-up programmes.

A block diagram of an embodiment of a hearing aid with a feedback compensation filter 106 is shown in FIG. 14. The hearing aid comprises a microphone 101 for receiving incoming sound and converting it into an audio signal. A receiver 102 converts output from the hearing aid processor 103 into output sound, which in, e.g., a hearing aid is supposed to be modified to compensate for a users hearing impairment. Thus, the hearing aid processor 103 comprises elements such as amplifiers, compressors and noise reduction systems etc.

A feedback path 104 is shown as a dashed line between the receiver 102 and the microphone 101. Due to the feedback path, the microphone 101 may pick up sound from the receiver 102 which may lead to well known feedback problems, such as whistling.

The (frequency dependent) gain response (or transfer function) H(ω) of the hearing aid (without feedback compensation) is given by:

$$H(\omega) = \frac{A(\omega)}{1 - F(\omega)A(\omega)} \tag{1}$$

where ω represents (angular) frequency, F(ω) is the gain function of the feedback path 104 and A(ω) is the gain function provided by the hearing aid processor 103. The feedback compensation filter 106 is adapted to feed a compensation signal to the subtraction unit 105, whereby the compensation signal is subtracted from the audio signal provided by the microphone 101 prior to processing in the hearing aid processor 103. The transfer function now becomes:

$$H(\omega) = \frac{A(\omega)}{1 - (F(\omega) - F'(\omega))A(\omega)} \quad (2)$$

where F'(ω) is the gain function of the compensation filter 106. Thus, F'(ω) estimates the true gain function F(ω) of the feedback path, the closer H(ω) will be to the desired gain function A(ω).

As previously explained, the feedback path 104 is usually a combination of internal and external feedback paths and acoustical and mechanical feedback paths.

The invention claimed is:

1. A hearing aid comprising:

a housing for accommodation of a signal processor for processing an audio signal into a processed audio signal compensating a hearing loss, and a receiver that is connected to an output of the signal processor for converting the processed audio signal into a sound signal;

wherein the housing is configured to be positioned in an ear canal of a user without obstructing the ear canal, thereby leaving a passageway between a part of an ear canal wall and a part of the housing so that sound waves can escape from behind the housing through the passageway to surroundings of the user, the housing having an output port for emission of sound towards an eardrum of the user when inserted in the ear canal; and wherein the housing is coupled to an elongate member, which is configured to be placed in a pinna and outside the ear canal of the user for retention of the housing in the ear canal.

2. The hearing aid according to claim 1, wherein the housing is configured to be positioned completely in the ear canal of the user.

3. The hearing aid according to claim 1, wherein the housing is manufactured in one of a plurality of standard sizes.

4. The hearing aid according to claim 1, wherein the elongate member is manufactured in one of a plurality of standard sizes.

5. The hearing aid according to claim 1, wherein the elongate member is removably attached to the housing through a snap fit coupling.

6. The hearing aid according to claim 1, wherein the elongate member has a longitudinal shape with a first end attached to the housing and an opposite second end.

7. The hearing aid according to claim 1, wherein the elongate member is configured to abut an antihelix and extends at least to an inferior crus of the antihelix during use.

8. The hearing aid according to claim 7, wherein the elongate member is configured so that the second end is located below a triangular fossa of the user during use.

9. The hearing aid according to claim 1, wherein the elongate member is configured to abut a part of a concha at an antitragus when the housing has been inserted in the ear canal, thereby applying a force to the housing towards the ear canal for retaining the housing in a position in which the housing is pressed against an anatomical feature within the ear canal.

10. The hearing aid according to claim 1, wherein the elongate member is flexible and preformed.

11. The hearing aid according to claim 1, wherein the elongate member is substantially rigid in its longitudinal direction.

12. The hearing aid according to claim 1, wherein the elongate member is configured for accommodation of a microphone.

13. The hearing aid according to claim 12, wherein the elongate member has a longitudinal shape with a first end attached to the housing and an opposite second end, and wherein a part of the elongate member for accommodating the microphone has a larger cross-section than a remaining part of the elongate member extending therefrom towards the first end.

14. The hearing aid according to claim 1, further comprising a battery door removably attached to the housing, wherein the elongate member is attached to the battery door.

15. The hearing aid according to claim 1, wherein the housing forms an angle along its longitudinal extension for facilitating accommodation of the housing in the ear canal of the user.

16. The hearing aid according to claim 15, wherein the housing is flexible for variation of the angle.

17. The hearing aid according to claim 1, further comprising a cerumen filter that is configured to be fitted on a loudspeaker with a snap on coupling, wherein the cerumen filter is coupled to the housing.

18. The hearing aid according to claim 1, further comprising a tinnitus relieving circuit that is provided with the housing.

19. The hearing aid of claim 1, wherein a part of the housing partially defines the passageway when the housing is in the ear canal.

20. A hearing aid comprising:

a housing for accommodation of a signal processor for processing an audio signal into a processed audio signal compensating a hearing loss, and a receiver that is connected to an output of the signal processor for converting the processed audio signal into a sound signal;

wherein the housing is configured to be positioned in an ear canal of a user without obstructing the ear canal, thereby leaving a passageway between a part of an ear canal wall and a part of the housing so that sound waves can escape from behind the housing through the passageway to surroundings of the user, the housing having an output port for emission of sound towards an eardrum of the user when inserted in the ear canal;

wherein the housing is coupled to an elongate member, which is configured to be placed in a pinna and outside the ear canal of the user for retention of the housing in the ear canal;

wherein the hearing aid further comprises a battery door removably attached to the housing, wherein the elongate member is attached to the battery door; and wherein the housing further comprises a connector for making electrical contact with a signal line in the elongate member when the battery door is attached to the housing.

21. A hearing aid comprising:

a housing for accommodation of a signal processor for processing an audio signal into a processed audio signal compensating a hearing loss, and a receiver that is connected to an output of the signal processor for converting the processed audio signal into a sound signal; and an elongate member coupled to the housing, wherein the elongate member is configured for accommodation of a microphone, and at least a part of the elongate member is flexible;

wherein the housing at least partially provides a passageway, so that when the housing is placed in an ear canal of a user, the passage way that is at least partially provided by the housing allows sound to pass from one side of the housing to another side of the housing.

22. The hearing aid according to claim 21, wherein the elongate member has a longitudinal shape with a first end attached to the housing and an opposite second end, and wherein a part of the elongate member for accommodating the microphone has a larger cross-section than a remaining part of the elongate member extending therefrom towards the first end.

23. The hearing aid according to claim 21, further comprising a battery door coupled to the housing.

24. The hearing aid according to claim 23, wherein the elongate member is attached to the battery door, and is coupled to the housing through the battery door.

25. A hearing aid comprising:

a housing for accommodation of a signal processor for processing an audio signal into a processed audio signal compensating a hearing loss, and a receiver that is connected to an output of the signal processor for converting the processed audio signal into a sound signal;

a battery door coupled to the housing; and an elongate member coupled to the housing, wherein the elongate member is configured for accommodation of a microphone, and at least a part of the elongate member is flexible;

wherein the elongate member is attached to the battery door, and is coupled to the housing through the battery door;

wherein the housing, when placed in an ear canal of a user, allows sound to pass from one side of the housing to another side of the housing; and wherein the housing further comprises a connector for making electrical contact with a signal line in the elongate member.

* * * * *